US006786710B2

(12) United States Patent
Rousseau

(10) Patent No.: US 6,786,710 B2
(45) Date of Patent: Sep. 7, 2004

(54) DISCHARGE PORTING FOR SCREW COMPRESSOR WITH TANGENTIAL FLOW GUIDE CUSP

(75) Inventor: William Herve Rousseau, Savannah, GA (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/231,404

(22) Filed: Aug. 27, 2002

(65) Prior Publication Data

US 2004/0042921 A1 Mar. 4, 2004

(51) Int. Cl.[7] ..... F04C 18/16
(52) U.S. Cl. ..... 418/201.1
(58) Field of Search ..... 418/201.1, 201.2

(56) References Cited

U.S. PATENT DOCUMENTS

| | | | | | |
|---|---|---|---|---|---|
| 3,088,658 | A | * | 5/1963 | Wagenius | 418/201.2 |
| 4,575,323 | A | * | 3/1986 | Yoshimura | 418/201.2 |
| 4,913,634 | A | * | 4/1990 | Nagata et al. | 418/201.1 |
| 5,137,439 | A | * | 8/1992 | Lundin | 418/201.1 |

* cited by examiner

*Primary Examiner*—John J. Vrablik
(74) *Attorney, Agent, or Firm*—Bachman & LaPointe, PC

(57) ABSTRACT

A screw compressor includes a housing having a discharge port; at least two rotors rotatably disposed in the housing for generating opposed discharge flows in radial and axial directions; and a tangential flow guide cusp disposed in the discharge port and at least partially defining a radial flow portion of the discharge port and having flow guiding surfaces arranged to guide tangential flows from said rotors so as to provide at least one of radial and axial directed flows.

4 Claims, 1 Drawing Sheet

DISCHARGE PORTING FOR SCREW COMPRESSOR WITH TANGENTIAL FLOW GUIDE CUSP

BACKGROUND OF THE INVENTION

The invention relates to screw compressors and, more particularly, to a screw compressor with enhanced discharge efficiency wherein kinetic energy can be converted to pressure.

Typical screw compressors increase pressure of refrigerant as it passes through rotating screws, and also impart kinetic energy to the refrigerant. This kinetic energy, however, is generally wasted in the discharge process.

Conventional efforts in screw compressor technology involve optimizing discharge port area to reduce discharge kinetic energy and/or reducing rotor speed to reduce kinetic energy.

It is clear that the need remains for improved efficiency in screw compressors.

It is, therefore, the primary object of the present invention to provide for conversion of kinetic energy into pressure, thereby reducing the work required to be done by the compressor and increasing efficiency.

It is a further object of the present invention to provide for re-direction of flow vectors to avoid interference and/or annihilation of opposing flows.

Other objects and advantages of the present invention will appear hereinbelow.

SUMMARY OF THE INVENTION

In accordance with the present invention, the foregoing objects and advantages have been readily attained.

According to the invention, a screw compressor is provided which comprises a housing having a discharge port; at least two rotors rotatably disposed in said housing for generating opposed discharge flows in radial and axial directions; and a tangential flow guide cusp disposed in said discharge port and at least partially defining a radial flow portion of said discharge port and having flow guiding surfaces arranged to guide tangential flows from said rotors so as to provide at least one of radial and axial directed flows.

BRIEF DESCRIPTION OF THE DRAWING

A detailed description of preferred embodiments of the present invention follows, with reference to the attached drawing, wherein.

DETAILED DESCRIPTION OF PREFERRED EMBODIMENT(S)

The invention relates to screw compressors and, more particularly, to improved discharge porting for converting kinetic energy from discharge flow from the compressor into pressure, thereby enhancing efficiency of the compressor and reducing the work needed to be done by the compressor for an equivalent amount of pressure.

One of the flow mechanisms in a conventional compressor discharge configuration is that the screws of the screw compressor generate a pair of opposing tangential velocity vectors which are maximum at the end wall, and which decrease toward the inlet end of the radial discharge port. These tangential components tend to annihilate each other and constrict the flow, thus causing significant pressure losses. The present invention relates to a flow guiding cusp which is incorporated into the discharge port of a compressor, and which re-directs these vectors radially and/or axially so as to reduce these negative effects and provide for efficient operation of the compressor.

Figure 1:
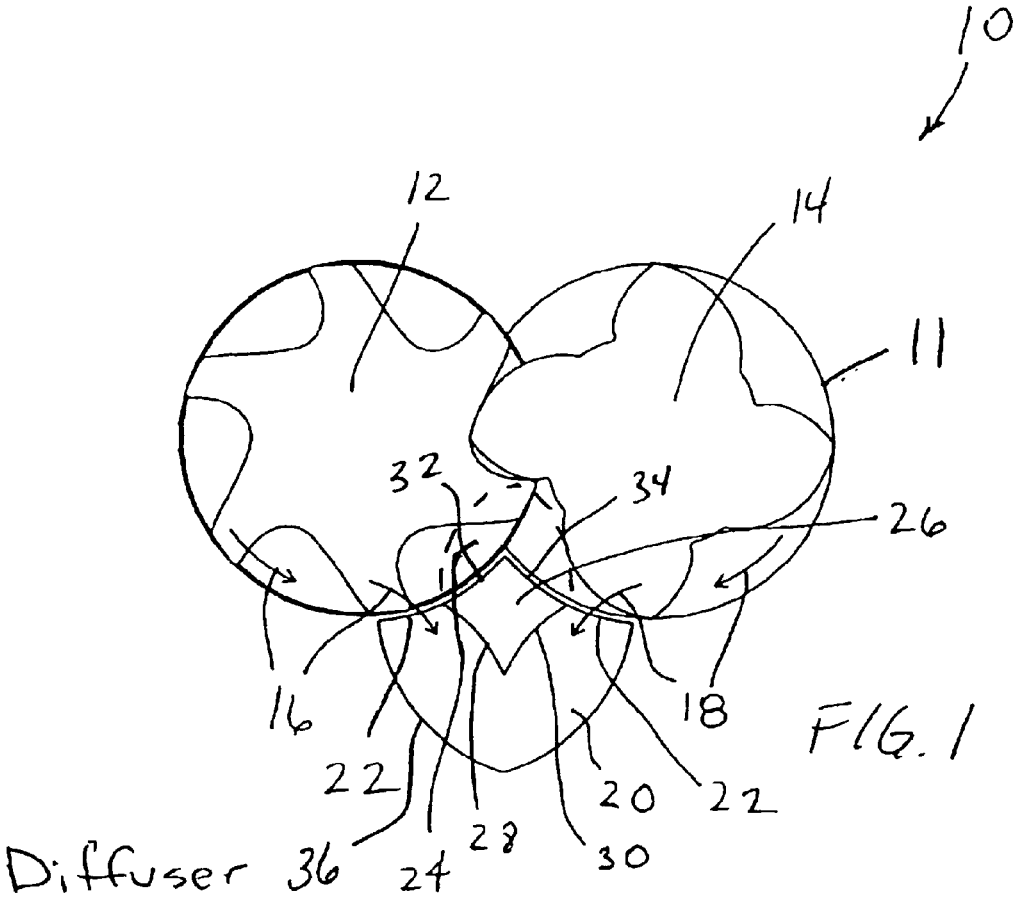
FIG. 1 schematically illustrates a portion of a screw compressor with enhanced discharge porting in accordance with the present invention.

FIG. 1 schematically illustrates a portion of a compressor 10 including first and second rotors 12, 14 which rotate within a housing 11 for generating discharge flows 16, 18 which are directed in non-parallel directions relative to each other, and in directions which have radial, tangential, and axial components relative to the rotors and rotor housing. Depending upon the speed of rotation of the rotors, or tip speed, substantial kinetic energy can be imparted to the refrigerant which, conventionally, contributes to losses due to turbulence, and has therefore been minimized. In accordance with the present invention, however, discharge porting is provided which can reduce the losses, thereby enhancing efficiency of the compressor and encouraging that which was conventionally viewed to be a disadvantage.

In accordance with the present invention, a discharge port 20 is provided in the compressor housing which has both a radial component 22 and an axial component 24, and a tangential flow guide cusp 26 is advantageously positioned in discharge port 20 so as to guide flow from discharge flows 16, 18 smoothly into an outlet, conduit or diffuser, and thereby enhance efficiency of flow, converting some kinetic energy from the flow into pressure.

In further accordance with the invention, axial component 24 of discharge port 20 is substantially aligned with tangential flow guide cusp 26. This is advantageous in that, as rotors 12, 14 rotate relative to radial component 22 and axial component 24 of discharge port 20, radial component 22 and axial component 24 are sequentially opened and closed, resulting in flow first through radial component 22 and then through axial component 24.

In accordance with the present invention, tangential flow guide cusp 26 advantageously comprises two arcuate or curved surfaces 28, 30, one each facing a discharge flow 16, 18 from rotors 12, 14, respectively, with curved surface 28, 30 arranged concave facing flows 16, 18. This advantageously smoothes and re-directs flow primarily from the tangential direction leaving rotors 12, 14 and into a diffuser or the like for further conveyance of compressed refrigerant. FIG. 1 further schematically illustrates a diffuser 36 for receiving and diffusing radial and axial flow of discharge flows 16, 18.

In further accordance with the invention, and also as shown in FIG. 1, tangential flow guide cusp 26 further has additional arcs 32, 34 which extend into an axial discharge area of the axial discharge port, and which advantageously serve to redirect tangential flow from the axial port to the axial and/or radial directions. Arcs 32, 34 may preferably be provided substantially parallel to the arc of the housing containing rotors 12, 14, and preferably include concave surface facing toward the rotor 12, 14 from which axial flow is to be guided.

Figure 2:
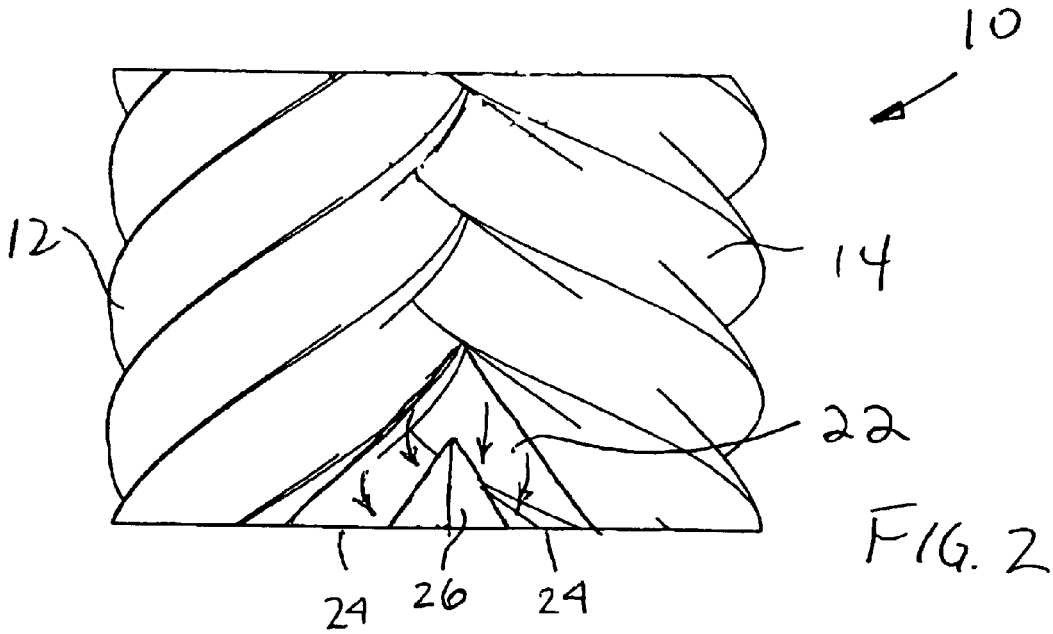
FIG. 2 schematically illustrates a side view of the embodiment of FIG. 1.

Turning to FIG. 2, a side-schematic view of the embodiment of FIG. 1 is further illustrated to show compressor 10 including rotors 12, 14 and flow guide cusp 26 guiding flow as desired.

In accordance with the present invention, it should be readily appreciated that an improvement has been provided for discharge porting of a screw compressor, which improvement advantageously serves to convert some kinetic energy imparted by the compressor into pressure, thereby enhancing compressor efficiency and allowing for the compressor to accomplish the desired pressure with a smaller amount of work.

This can lead to smaller compressors, less expensive equipment, increased operating efficiency, and other desirable advantages.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing having a discharge port;

at least two rotors rotatably disposed in said housing for generating opposed discharge flows in radial and axial directions; and a tangential flow guide cusp disposed in said discharge port and at least partially defining a radial flow portion of said discharge port and having flow guiding surfaces arranged to guide tangential flows from said rotors so as to provide at least one of radial and axial directed flows, wherein said flow guiding surfaces include radial flow guiding surfaces which converge to define a cusp point directed away from said rotors, and axial flow guiding surfaces which converge to define a cusp point directed toward said rotors.

2. The apparatus of claim 1, further comprising a diffuser communicated with said discharge port for receiving said at least one of radial and axial directed flows.

3. The apparatus of claim 1, wherein said tangential flow guide cusp further comprises additional flow guiding surfaces arranged to guide tangential flow from an axial flow portion of said discharge port so as to provide at least one of radial and axial directed flows through said axial flow portion.

4. The apparatus of claim 1, wherein said flow guiding surfaces comprise concave surfaces facing said at least two rotors.

* * * * *